US011219931B2

(12) United States Patent
Khamatnurova et al.

(10) Patent No.: US 11,219,931 B2
(45) Date of Patent: Jan. 11, 2022

(54) REMOVAL OF GELS FORMED FROM LIQUID FRICTION-REDUCING FLUIDS

(71) Applicant: Halliburton Energy Services, Inc., Houston, TX (US)

(72) Inventors: Tatyana V. Khamatnurova, Spring, TX (US); Paul Joseph Jones, Houston, TX (US); Robert Douglas Hillard, Houston, TX (US); Melissa Christine Weston, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 41 days.

(21) Appl. No.: 16/734,169

(22) Filed: Jan. 3, 2020

(65) Prior Publication Data

US 2021/0205859 A1 Jul. 8, 2021

(51) Int. Cl.
*B08B 9/027* (2006.01)
*E21B 41/00* (2006.01)

(52) U.S. Cl.
CPC ..... *B08B 9/027* (2013.01); *E21B 41/00* (2013.01); *B08B 2209/027* (2013.01)

(58) Field of Classification Search
CPC ... B08B 9/027; B08B 2209/027; E21B 41/00; E21B 43/26; C09K 8/035
See application file for complete search history.

(56) References Cited

U.S. PATENT DOCUMENTS

| | | | | |
|---|---|---|---|---|
| 5,224,544 | A * | 7/1993 | Tjon-Joe-Pin | C09K 8/512 166/294 |
| 7,232,793 | B1 * | 6/2007 | King | C09K 8/035 507/120 |
| 8,481,462 | B2 | 7/2013 | Lin et al. | |
| 2003/0217846 | A1 | 11/2003 | Coronado et al. | |
| 2005/0022993 | A1 * | 2/2005 | Wilson | C09K 8/68 166/295 |
| 2011/0030953 | A1 * | 2/2011 | Li | C09K 8/502 166/280.2 |
| 2013/0130948 | A1 * | 5/2013 | Crews | C09K 8/88 507/215 |

(Continued)

FOREIGN PATENT DOCUMENTS

| | | | |
|---|---|---|---|
| EP | 0103779 | A2 | 3/1984 |
| WO | 2016126546 | A1 | 8/2016 |
| WO | 2018085743 | A1 | 5/2018 |

OTHER PUBLICATIONS

International Search Report and Written Opinion issued for corresponding International Patent Application No. PCT/US2020/013103 dated Sep. 25, 2020.

(Continued)

*Primary Examiner* — Sharidan Carrillo
(74) *Attorney, Agent, or Firm* — McGuireWoods LLP

(57) ABSTRACT

Methods and systems for removing a gel from wellbore equipment. An example method includes introducing a cleaning fluid into the wellbore equipment comprising the gel disposed therein or thereon. The cleaning fluid includes a brine having a total dissolved solids concentration of between about 30K ppm to about 300K ppm. The method further includes contacting the gel with the cleaning fluid in the wellbore equipment, and removing the gel and the cleaning fluid from the wellbore equipment.

11 Claims, 2 Drawing Sheets

(56) References Cited

U.S. PATENT DOCUMENTS

| | | | | |
|---|---|---|---|---|
| 2016/0009983 | A1* | 1/2016 | Li | C09K 8/887<br>507/225 |
| 2016/0376494 | A1 | 12/2016 | Oyj | |
| 2021/0205859 | A1* | 7/2021 | Khamatnurova | E21B 41/00 |

OTHER PUBLICATIONS

Y. Zhang, et al., Specific Ion Effects on the Water Solubility of Macromolecules: PNIPAM and the Hofeister Series, Journal of American Chemical Society Articles; Sep. 22, 2005, 127, 14505-14510.

* cited by examiner

REMOVAL OF GELS FORMED FROM LIQUID FRICTION-REDUCING FLUIDS

TECHNICAL FIELD

The present disclosure relates generally to wellbore operations, and more particularly, to the use of cleaning fluids for removing at least a portion of the gels formed in wellbore equipment from the water contamination of a liquid friction-reducing fluid.

BACKGROUND

Hydrocarbon producing formations may be stimulated by hydraulic fracturing treatments. In some hydraulic fracturing treatments, a liquid friction-reducing fluid may be used to reduce the friction of a fluid as it flows through a tubular or pumping equipment to achieve desirable pump rates and flow rates of the fracturing fluid. The liquid friction-reducing fluids may be emulsion polymerized and comprise a continuous hydrocarbon phase and an internal discontinuous friction-reducing polymer phase, for example, polyacrylamide. Alternatively, the liquid friction-reducing fluids may be a suspension of polymer powder in a liquid hydrocarbon.

Contact of the liquid friction-reducing fluids with polar solvents such as water may break the emulsion or suspension and induce gelation as the friction-reducing polymer may swell upon contact with water. Transport, blending, and pumping equipment for the liquid friction-reducing fluids may be kept oil-wet and free of water. However, contamination of transport and pumping equipment with water may still occur due to humidity, pushed-back water from pump fittings, leaks in valves, etc. Should the liquid friction-reducing fluids make contact with the contaminant water, the formed gel may need to be removed from the associated wellbore equipment. The present disclosure provides improved methods and compositions regarding cleaning fluids for removing at least a portion of the gels formed from the water contamination of a liquid friction-reducing fluid.

BRIEF DESCRIPTION OF THE DRAWINGS

Illustrative examples of the present disclosure are described in detail below with reference to the attached drawing figures, which are incorporated by reference herein, and wherein.

Figure 1:
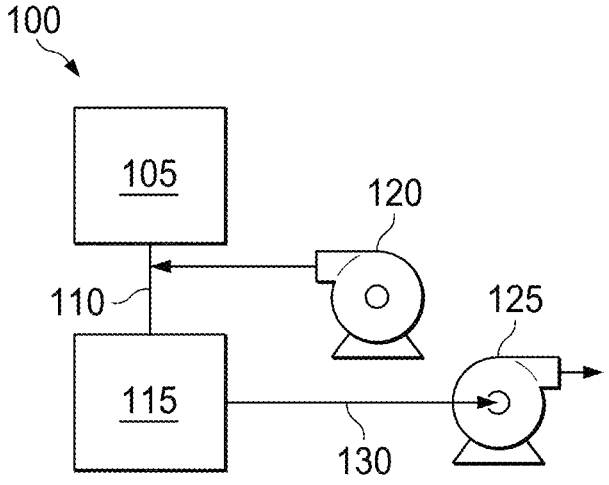
FIG. 1 is a schematic illustrating a system of surface equipment to be cleaned by a cleaning fluid in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to wellbore operations, and more particularly, to the use of cleaning fluids for removing at least a portion of the gels formed in wellbore equipment from the water contamination of a liquid friction-reducing fluid.

In the following detailed description of several illustrative examples, reference is made to the accompanying drawings that form a part hereof, and in which is shown by way of illustration, examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples is defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present disclosure. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

As used herein, the term "formation" encompasses the term "reservoir," referring to a portion of the formation which has sufficient porosity and permeability to store or transmit fluids (e.g., hydrocarbons). As used herein, the term "fracturing fluid" refers generally to any fluid that may be used in a subterranean application in conjunction with a desired function and/or for a desired purpose. The term "fracturing fluid" does not imply any particular action by the fluid or any component thereof.

The examples described herein relate to the use of cleaning fluids for removing at least a portion of the gels formed by the water contamination of a liquid friction-reducing fluid in wellbore equipment. The cleaning fluids may be introduced into the wellbore equipment to remove the formed gel. The cleaning fluids may reduce the viscosity of the gel, thereby allowing the gel to be flushed from the wellbore equipment by the cleaning fluid or a subsequently introduced flush or displacement fluid. The cleaning fluid generally comprises a brine. Advantageously, the brine may contain water sourced from any water source such as freshwater, brackish water, saline water, seawater, saturated saltwater, disposal water, recycled water, produced water, formation water, Ellenberger brines, etc. If the water source does not contain a sufficient concentration of desirable dissolved solids, additional salts or brines may be added to increase the total concentration of desirable dissolved solids. As such, the water source for the brine may be readily available and/or readily prepared in some instances. As a further advantage, the brine may contain a variety of ions including alkali metal halide, alkali earth metal halides, Hofmeister series anions and cations, kosmotropic ions, chaotropic ions, etc. Another advantage is that the cleaning fluid provides a cost-efficient method of gel removal. An additional advantage is that the cleaning fluids are safe for hydraulic fracturing operations and may not degrade the wellbore or formation. One other advantage is that the cleaning fluids are safe for handling by wellsite personnel. A still further advantage is that the cleaning fluids may be switched into the system to quickly flush a formed gel when pump efficiency decreases and then be switched out quickly to continue the regular operation. Thus, the cleaning fluids may be used efficiently without the need to shut-down well equipment for a complicated and/or time consuming clean-out operation.

The cleaning fluids of the present disclosure comprise a brine. The brine comprises an aqueous fluid and dissolved ions. The ions are provided from the dissolution of salts in the aqueous fluid. The ions may be monovalent, divalent, trivalent, etc. The salts to be dissolved in the aqueous fluid may be alkali metal salts, alkali earth metal salts, halide salts, chaotropic salts, kosmotropic salts, the like, derivatives thereof, hydrates thereof, and any combination thereof. The dissolved ions may be lithium, sodium, potassium, rubidium, caesium, beryllium, magnesium, calcium, strontium, barium, radium, fluoride, chloride, bromide, iodide, aluminum, boron, gallium, indium, perchlorate, citrate, nitrate, phosphate, hydrogen phosphate, dihydrogen phosphate, sulfate, ammonium, tetramethylammonium, the like, and any combination of ions. With the benefit of this disclosure, one of ordinary skill in the art will be able to formulate a cleaning fluid having suitable ions for a desired application.

In some examples, the cleaning fluids comprise a brine having a total dissolved solids ("TDS") concentration of between about 30K ppm to about 300K ppm. The concentration may range from any lower limit to any upper limit and encompass any subset between the upper and lower limits. Some of the lower limits listed may be greater than some of the listed upper limits. One skilled in the art will recognize that the selected subset may require the selection of an upper limit in excess of the selected lower limit. Therefore, it is to be understood that every range of values is encompassed within the broader range of values. For example, the TDS in the cleaning fluids may range from about 30K ppm to about 300K ppm, from about 35K ppm to about 300K ppm, from about 40K ppm to about 300K ppm, from about 45K ppm to about 300K ppm, from about 50K ppm to about 300K ppm, from about 55K ppm to about 300K ppm, from about 60K ppm to about 300K ppm, from about 65K ppm to about 300K ppm, from about 70K ppm to about 300K ppm, from about 75K ppm to about 300K ppm, from about 80K ppm to about 300K ppm, from about 85K ppm to about 300K ppm, from about 90K ppm to about 300K ppm, from about 95K ppm to about 300K ppm, from about 100K ppm to about 300K ppm, from about 105K ppm to about 300K ppm, from about 110K ppm to about 300K ppm, from about 115K ppm to about 300K ppm, from about 120K ppm to about 300K ppm, from about 125K ppm to about 300K ppm, from about 130K ppm to about 300K ppm, from about 135K ppm to about 300K ppm, from about 140K ppm to about 300K ppm, from about 145K ppm to about 300K ppm, from about 150K ppm to about 300K ppm, from about 155K ppm to about 300K ppm, from about 160K ppm to about 300K ppm, from about 165K ppm to about 300K ppm, from about 170K ppm to about 300K ppm, from about 175K ppm to about 300K ppm, from about 180K ppm to about 300K ppm, from about 185K ppm to about 300K ppm, from about 190K ppm to about 300K ppm, from about 195K ppm to about 300K ppm, from about 200K ppm to about 300K ppm, from about 205K ppm to about 300K ppm, from about 210K ppm to about 300K ppm, from about 215K ppm to about 300K ppm, from about 220K ppm to about 300K ppm, from about 225K ppm to about 300K ppm, from about 230K ppm to about 300K ppm, from about 235K ppm to about 300K ppm, from about 240K ppm to about 300K ppm, from about 245K ppm to about 300K ppm, from about 250K ppm to about 300K ppm, from about 255K ppm to about 300K ppm, from about 260K ppm to about 300K ppm, from about 265K ppm to about 300K ppm, from about 270K ppm to about 300K ppm, from about 275K ppm to about 300K ppm, from about 280K ppm to about 300K ppm, from about 285K ppm to about 300K ppm, from about 290K ppm to about 300K ppm, or from about 295K ppm to about 300K ppm. As another example, the TDS in the cleaning fluids may range from about 30K ppm to about 300K ppm, from about 30K ppm to about 295K ppm, from about 30K ppm to about 290K ppm, from about 30K ppm to about 285K ppm, from about 30K ppm to about 280K ppm, from about 30K ppm to about 275K ppm, from about 30K ppm to about 270K ppm, from about 30K ppm to about 265K ppm, from about 30K ppm to about 260K ppm, from about 30K ppm to about 255K ppm, from about 30K ppm to about 250K ppm, from about 30K ppm to about 245K ppm, from about 30K ppm to about 240K ppm, from about 30K ppm to about 235K ppm, from about 30K ppm to about 230K ppm, from about 30K ppm to about 225K ppm, from about 30K ppm to about 220K ppm, from about 30K ppm to about 215K ppm, from about 30K ppm to about 210K ppm, from about 30K ppm to about 205K ppm, from about 30K ppm to about 200K ppm, from about 30K ppm to about 195K ppm, from about 30K ppm to about 190K ppm, from about 30K ppm to about 185K ppm, from about 30K ppm to about 180K ppm, from about 30K ppm to about 175K ppm, from about 30K ppm to about 170K ppm, from about 30K ppm to about 165K ppm, from about 30K ppm to about 160K ppm, from about 30K ppm to about 155K ppm, from about 30K ppm to about 150K ppm, from about 30K ppm to about 145K ppm, from about 30K ppm to about 140K ppm, from about 30K ppm to about 135K ppm, from about 30K ppm to about 130K ppm, from about 30K ppm to about 125K ppm, from about 30K ppm to about 120K ppm, from about 30K ppm to about 115K ppm, from about 30K ppm to about 110K ppm, from about 30K ppm to about 105K ppm, from about 30K ppm to about 100K ppm, from about 30K ppm to about 95K ppm, from about 30K ppm to about 90K ppm, from about 30K ppm to about 85K ppm, from about 30K ppm to about 80K ppm, from about 30K ppm to about 75K ppm, from about 30K ppm to about 70K ppm, from about 30K ppm to about 65K ppm, from about 30K ppm to about 60K ppm, from about 30K ppm to about 55K ppm, from about 30K ppm to about 50K ppm, from about 30K ppm to about 45K ppm, from about 30K ppm to about 40K ppm, or from about 30K ppm to about 35K ppm. With the benefit of this disclosure, one of ordinary skill in the art will be readily able to prepare a cleaning fluid having a sufficient concentration of dissolved salts for a given application.

The cleaning fluids described herein comprise an aqueous base fluid comprising the dissolved salts and/or the fluid to which salts are to be added and dissolved. The aqueous fluid may be from any source and, in some examples, may already be a brine having a concentration of dissolved salts. Examples of the aqueous fluid include, but are not limited to freshwater, brackish water, saline water, seawater, saturated saltwater, disposal water, recycled water, produced water, formation water, Ellenberger brines, the like, and any combinations thereof. One of ordinary skill in the art, with the benefit of this disclosure, should be readily able to select an aqueous fluid for the preparation of the cleaning fluid. With the benefit of this disclosure, one of ordinary skill in the art will be able to formulate a cleaning fluid having a suitable aqueous base fluid for a desired application.

In examples where the aqueous base fluid does not comprise a sufficient concentration of dissolved solids, salt may be added to the aqueous base fluid to increase the total dissolved solids concentration. In some examples, one or more salts may be added to the aqueous base fluid. In other examples, the aqueous base fluid may be mixed with another aqueous base fluid, for example, a brine having a high concentration of dissolved salts, such as saturated seawater or recycled produced water, disposal water, etc., to increase the overall dissolved solids concentration in the aqueous base fluid. With the benefit of this disclosure, one of ordinary skill in the art will be able to prepare a cleaning fluid having a sufficient concentration of dissolved salts.

The cleaning fluids may be used to remove gels formed from the water contamination of a liquid friction-reducing fluid. The liquid friction-reducing fluid may be an emulsion comprising a continuous hydrocarbon phase and a discontinuous phase comprising the polymeric fluid-friction reducer. Alternatively, the liquid friction-reducing fluid may be a suspension of polymer powder in a liquid hydrocarbon. The hydrocarbon phase may comprise any hydrocarbon. The polymeric fluid-friction reducer may comprise any polymeric fluid-friction reducer including, but not limited to, polyacrylamide, poly 2-acrylamido-2-methylpropane sulfonic acid, polybutylene succinate, polybutylene succinate-co-adipate, polyhydroxybutyrate-valerate, polyhydroxybutyrate-covalerate, polycaprolactone, polyethylene terephthalate-based polymers, sulfonated polyethylene terephthalate, polyethylene oxide, polyethylene, polypropylene, polyvinyl alcohol, aliphatic aromatic copolyester, polyacrylic acid, polyvinylpyrrolidone, polysaccharide, aliphatic polyester, polylactic acid, poly(glycolide), poly(ε-caprolactone), poly(hydroxy ester ether), poly(hydroxybutyrate), poly(anhydride), polycarbonate, poly(orthoester), poly (amino acid), poly(ethylene oxide), poly(propylene oxide), poly(phosphazene), derivatives thereof, and any combination of polymeric fluid-friction reducers. The polymeric fluid-friction reducer may form a gel when exposed to water or other polar solvents. This may be due to the water or other polar solvents breaking the emulsion or suspension of the liquid friction-reducing fluid. The gel may form through the swelling of the polymeric fluid-friction reducer through absorption of the water or other polar solvent. If the gel forms in wellbore equipment, it may reduce the pumping efficiency and impede the operation. The cleaning fluid may remove the gel by acting on the polymeric fluid-friction reducer to reduce the viscosity of the formed gel. In some optional examples, the cleaning fluid may induce a conformational change in the configuration of the polymeric fluid-friction reducer from an extended coil to a contracted configuration. In some optional examples, the liquid friction-reducing fluids may be dearomatized. In other optional examples, the liquid friction-reducing fluids may comprise benzene, toluene, xylenes, etc.

In some optional examples, the cleaning fluids may comprise an additive. The additive may be used to adjust a property of the cleaning fluids (e.g., viscosity, density, etc.). Examples of suitable additives include, but are not limited to, corrosion inhibitors, surfactants, anti-oxidants, polymer degradation prevention additives, relative permeability modifiers, scale inhibitors, foaming agents, defoaming agents, antifoaming agents, iron control agents, particulate diverters, salts, fluid loss control additives, gas, catalysts, clay control agents, dispersants, flocculants, scavengers (e.g., $H_2S$ scavengers, or $O_2$ scavengers), lubricants, friction reducers, bridging agents, weighting agents, solubilizers, paraffin/asphaltenes inhibitors, emulsion breaker, hydrate inhibitors, consolidating agents, bactericides, clay stabilizers, breakers, delayed release breakers, the like, or any combination thereof. With the benefit of this disclosure, one of ordinary skill in the art will be able to formulate a cleaning fluid having properties suitable for a desired application.

The present disclosure provides cleaning fluids, methods, and systems for removing at least a portion of the gels formed from the water contamination of a liquid friction-reducing fluid. The cleaning fluids comprise a dissolved salt and an aqueous base fluid. The methods may include preparing one or more cleaning fluids by adding salt or ions to the aqueous base fluid to form or enhance a brine. The methods may include pumping one or more cleaning fluids through wellbore equipment in which a gel has formed. The methods may also include removing at least a portion of the cleaning fluid and at least a portion of the formed gel from the wellbore equipment. The systems may include pumping and mixing equipment to be cleaned by the cleaning fluid.

Example systems may comprise a pump fluidly coupled to a tubular, the tubular containing a liquid friction-reducing fluid as described herein. The pump may be a high-pressure pump or a low-pressure pump. As used herein, the term "high-pressure pump" will refer to a pump that is capable of delivering a fluid at a pressure of about 1000 psi or greater. Suitable high-pressure pumps may include, but are not limited to, floating piston pumps and positive displacement pumps. In other examples, the pump may be a low-pressure pump. As used herein, the term "low-pressure pump" will refer to a pump that operates at a pressure less than about 1000 psi. In some examples, a low-pressure pump may be fluidly coupled to a high-pressure pump that is fluidly coupled to the tubular. That is, the low-pressure pump may be configured to convey a fluid to the high-pressure pump.

In such examples, the low-pressure pump may "step up" the pressure of the fluid before it reaches the high-pressure pump. Suitable low-pressure pumps may include, but are not limited to, chemical additive pumps, centrifugal pumps, etc. In any example, a high-pressure pump and/or a low-pressure pump may convey a fluid to the target location while suppling sufficient pressure. In some examples, the formed gel may be formed in the pump and the pump may require cleaning. The cleaning fluid may be used to remove the formed gel from the pump. The cleaning fluid may be flushed afterwards through normal operation, for example, by introduction of a hydrocarbon-based fluid to displace the cleaning fluid.

In some examples, the systems described herein may further comprise a mixing tank that is upstream of the pump and is the vessel in which the cleaning fluid is formulated or made ready to deploy into the transporting conduit, storage container, and/or pump. In various examples, a pump (e.g., a low-pressure pump, a high-pressure pump, or a combination thereof) may convey the cleaning fluid from the mixing tank to its target location. In other examples, the cleaning fluid may be formulated offsite and transported to a worksite, in which case the cleaning fluid may be introduced to the transporting conduit via the pump either directly from its shipping container (e.g., tote, pit, truck railcar, barge, or the like) or from a transport pipeline. In either case, the cleaning fluid may be drawn into the pump and/or transporting conduit to remove a formed gel. In some examples, the formed gel may be formed in the mixing tank and the mixing tank may require cleaning. The cleaning fluid may be used to remove the formed gel from the mixing tank. The cleaning fluid may be flushed afterwards through normal operation, for example, by introduction of a hydrocarbon-based fluid to displace the cleaning fluid.

In some examples, the systems described herein may further comprise a transporting conduit, which may be hosing, tubing, tubulars or any variation of a conduit for fluid flow. In various examples, the transporting conduit may convey the cleaning fluid from the storage container, mixing tank, pump, etc. to a target location, which may be the storage container, mixing tank, pump, or another section of a transporting conduit. In some examples, the formed gel may be formed in the transporting conduit and the transporting conduit may require cleaning. The cleaning fluid may be used to remove the formed gel from the transporting conduit. The cleaning fluid may be flushed afterwards through normal operation, for example, by introduction of a hydrocarbon-based fluid to displace the cleaning fluid.

In some examples, the systems described herein may further comprise a storage container for storage of the liquid friction-reducing fluid. In some examples, the formed gel may be formed in the storage container and the storage container may require cleaning. The cleaning fluid may be used to remove the formed gel from the storage container. The cleaning fluid may be flushed afterwards through normal operation, for example, by introduction of a hydrocarbon-based fluid to displace the cleaning fluid.

FIG. 1 illustrates a schematic of the surface and near-surface portions of a system 100 that can deliver a liquid friction-reducing fluid to a downhole location, according to one or more examples. It should be noted that while FIG. 1 generally depicts a land-based system, it is to be recognized that like systems may be operated in subsea locations as well. As depicted in FIG. 1, system 100 may include storage container tank 105, in which a fluid or base fluid, such as the cleaning fluid, the liquid friction-reducing fluid, aqueous base fluid, or hydrocarbon base fluid may be stored. The fluid may be conveyed via transporting conduit 110 to mixing tank 115, where a downhole fluid such as a fracturing fluid may be formulated. Chemical additive pump 120 may inject a chemical additive, which may comprise a fluid, such as the liquid friction-reducing fluid, or a component of a fluid, such as the polymeric fluid-friction reducer. The chemical additive pump 120 may convey the chemical additive to the mixing tank 115, any transporting conduit, the storage tank 105, or to another pump. After mixing tank 115 has prepared the downhole fluid, the downhole fluid may be transported to a pump 125 via transporting conduit 130. Pump 125 may be any type of pump, including low-pressure or high-pressure pumps. Pump 125 may convey the downhole fluid to a target location.

The cleaning fluid may be introduced to any or all of the aforementioned pieces of wellbore equipment. Should any of the pieces of wellbore equipment be contaminated with water or other polar solvents, a gel may form if a liquid friction-reducing fluid is introduced. The wellbore equipment may be kept oil-wet to prevent such contamination; however, contamination may still occur due to humidity, leaks, fluid push-back, etc. The cleaning fluid may be used to remove a formed gel from any of these pieces of wellbore equipment. In some examples, the cleaning fluid may be formulated prior to introduction into system 100. For example, if a water source, such as recycled produced water has an insufficient dissolved solids concentration, the dissolved solids concentration may be increased to a desirable level by introduction of additional salt or mixing the recycled produced water with a sufficiently concentrated brine to produce the cleaning fluid. This prepared fluid may then be introduced into system 100. In other examples, the cleaning fluid may be formulated within system 100 by mixing an aqueous base fluid with a desirable salt or sufficiently concentrated brine to produce the cleaning fluid in the mixing tank 115. The cleaning fluid may then be introduced to the other pieces of wellbore equipment to remove any gels formed prior.

In some examples, a wellbore operation may be ongoing at the time of introduction of the cleaning fluid 100. For example, a fracturing operation may be ongoing. Should pump efficiency decrease, the cleaning fluid may be introduced to system 100 to remove any gel formed within. In some examples, the introduction of the cleaning fluid may not require shutdown of system 100. Instead, the system 100 may switch open a transporting conduit to introduce the cleaning fluid to the wellbore equipment. After a sufficient volume of cleaning fluid is introduced such that pumping efficiency has been restored/improved, the system 100 may switch the transporting conduit back to its original operation.

The cleaning fluid and the gel may be flushed from the system by a flush or displacement fluid such as a hydrocarbon-based fluid and/or may be flushed from the system by the fluid that was originally being prepped and pumped by the system 100. As the cleaning fluid comprises a brine having a high concentration of dissolved salts, it may be beneficial to flush the cleaning fluid quickly after it has acted to reduce the possibility of degrading the wellbore equipment. The cleaning fluid may be pumped down the wellbore in some examples, thereby decreasing the volume of fluid that must be transported off the wellsite.

In some further optional examples, the cleaning fluid may be recycled and reused in the same well system 100 or a different well system reducing the overall volume of cleaning fluid to prepare and use.

It is to be understood that system 100 is a schematic or one possible configuration of an example fluid preparation and delivery system 100. The individual pieces of wellbore equipment may be rearranged as would be readily apparent to one of ordinary skill in the art. For example, the chemical additive pump 120 may be directly coupled to the mixing tank 115 or the storage container 105 instead of to the transporting conduit 115. In some examples, one or more pieces of wellbore equipment may be absent. In other examples, there may be additional pieces of wellbore equipment, for example, additional mixing tanks 115, transporting conduits, storage tanks 105, etc. As such, it is to be recognized that system 100 is merely exemplary in nature, and various additional configurations may be used that have not necessarily been depicted in FIG. 1 in the interest of clarity. Moreover, non-limiting additional components may be present, including, but not limited to, supply hoppers, valves, condensers, adapters, joints, gauges, sensors, compressors, pressure controllers, pressure sensors, flow rate controllers, flow rate sensors, temperature sensors, and the like.

It should be clearly understood that the example illustrated by FIG. 1 is merely a general application of the principles of this disclosure in practice, and a wide variety of other examples are possible. Therefore, the scope of this disclosure is not limited in any manner to the details of FIG. 1 as described herein.

Figure 2:
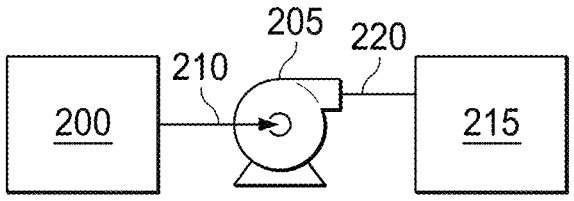
FIG. 2 is a schematic illustrating a tote for the introduction of a cleaning fluid into a system to be cleaned in accordance with one or more examples described herein.

FIG. 2 illustrates a tote 200, which may be used to carry the cleaning fluid. The tote 200 may be connected to a pump 205 via any suitable transporting conduit 210. The pump 205 may be a positive displacement pump or a centrifugal pump. The pump 205 may pump and introduce the cleaning fluid into a system 215 via any suitable transporting conduit 220. The system 215 may be any surface system comprising a gel that needs removal. After introduction of the cleaning fluid into the system 215, the cleaning fluid and the gel may be flushed from the system 215 by a flush or displacement fluid such as a hydrocarbon-based fluid and/or may be flushed from the system 215 by the fluid that was originally being prepped and pumped by the system.

It should be clearly understood that the example illustrated by FIG. 2 is merely a general application of the principles of this disclosure in practice, and a wide variety of other examples are possible. Therefore, the scope of this disclosure is not limited in any manner to the details of FIG. 2 as described herein.

It is also to be recognized that the disclosed systems and cleaning fluids may also directly or indirectly affect the various downhole equipment and tools that may contact the systems and cleaning fluids disclosed herein. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the methods and systems generally described above and depicted in FIG. 1.

EXAMPLES

The present disclosure may be better understood by reference to the following examples, which are offered by way of illustration. The present disclosure is not limited to the examples provided herein.

Example 1

A comparative experiment was performed using a control sample of tap water and three experimental samples comprising increasing concentrations of dissolved salts. A first experimental sample comprised a cleaning fluid having a TDS concentration of 30K ppm. A second experimental sample comprised a cleaning fluid having a TDS concentration of 150K ppm. A third experimental sample comprised a cleaning fluid having a TDS concentration of 300K ppm. The cleaning fluids comprised dissolved salts of NaCl, $CaCl_2$, and MgCl hexahydrate.

A liquid friction-reducing fluid was placed into four jars and each was contaminated with fresh water to form a gel in each jar. The three experimental samples and the control sample were then added individually to a single jar each. The samples were mixed with the gels. Each of the cleaning fluids reduced the viscosity of the gel. The 300K ppm TDS provided the largest reduction in viscosity. The tap water control sample did not measurably reduce the viscosity of the gel.

Figure 3:
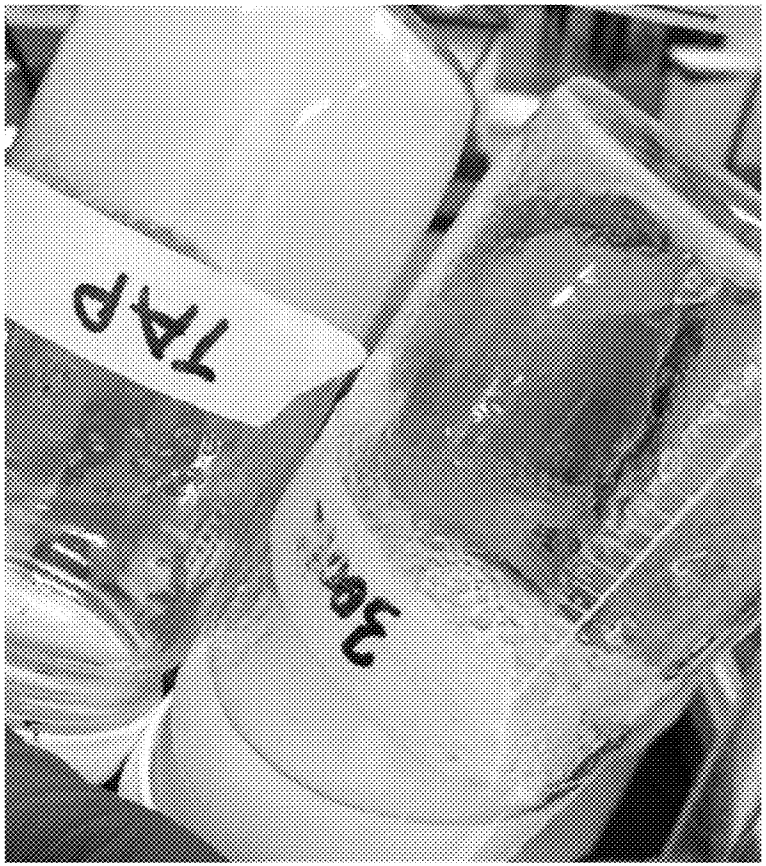
FIG. 3 is a photograph illustrating the flowability of a gel treated with a cleaning fluid in accordance with one or more examples described herein versus a gel treated with tap water.

FIG. 3 is a photograph illustrating the tap water sample and the 300K ppm TDS sample when inverted. The gel formed in the tap water sample remained extremely viscous and was not flowable. The gel in the 300 k ppm TDS sample was flowable and could be easily cleaned from the jar.

Figure 4:
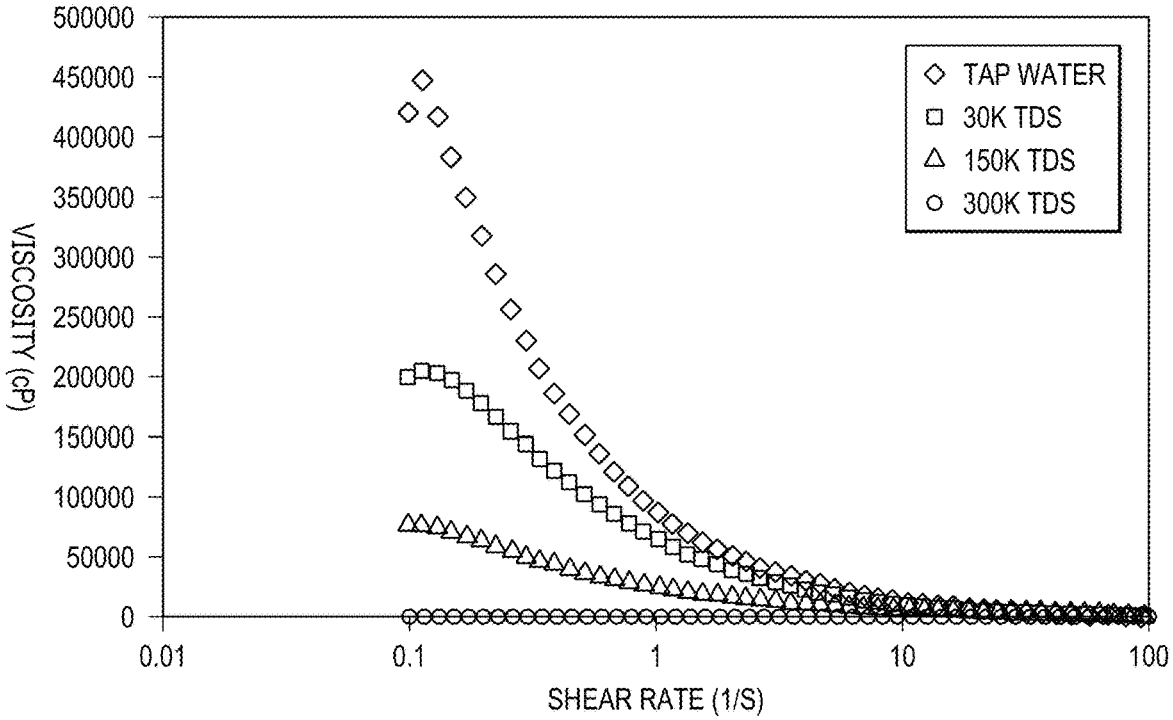
FIG. 4 is a graph illustrating the change in viscosity versus shear rate for gels treated with various formulations of a cleaning fluid in accordance with one or more examples described herein.

FIG. 4 is a graph illustrating the change in viscosity over increasing shear rate. As illustrated, the samples having a higher concentration of dissolved salts require less shear to reduce the viscosity of the gel.

Provided are methods of removing at least a portion of the gel from the wellbore equipment in accordance with the disclosure. An example method comprises introducing a cleaning fluid into the wellbore equipment having the gel disposed therein or thereon; wherein the cleaning fluid comprises a brine having a total dissolved solids concentration of between about 30K ppm to about 300K ppm; contacting the gel with the cleaning fluid in the wellbore equipment; and removing at least a portion of the gel and at least a portion of the cleaning fluid from the wellbore equipment.

Additionally or alternatively, the method may include one or more of the following features individually or in combination. The wellbore equipment may be operating and wherein the steps of the method are performed without shutting down the wellbore equipment. The wellbore equipment may be in process of performing a wellbore operation, wherein the method further comprises introducing the cleaning fluid into the wellbore equipment without shutting down the wellbore equipment and then removing at least a portion of the gel and the cleaning fluid from the wellbore equipment and continuing with the wellbore operation. The brine may comprise a dissolved salt selected from the group consisting of alkali metal salts, alkali earth metal salts, halide salts, chaotropic salts, kosmotropic salts, the like, derivatives thereof, hydrates thereof, and any combination thereof.

The brine may comprise an ion selected from the group consisting of lithium, sodium, potassium, rubidium, caesium, beryllium, magnesium, calcium, strontium, barium, radium, fluoride, chloride, bromide, iodide, aluminum, boron, gallium, indium, perchlorate, citrate, nitrate, phosphate, hydrogen phosphate, dihydrogen phosphate, sulfate, ammonium, tetramethylammonium, and any combination thereof. The wellbore equipment comprising the gel may be a transporting conduit, mixing tank, storage container, pump, or a combination thereof. The brine may comprise an aqueous base fluid selected from the group consisting of freshwater, brackish water, saline water, seawater, saturated saltwater, disposal water, recycled water, produced water, formation water, Ellenberger brines, the like, and any combinations thereof. The method may further comprise recycling a produced or disposal water by using the produced or disposal water as the cleaning fluid. The method may further comprise recycling produced or disposal water by adding salt to a produced or disposal water and then using the produced or disposal water as the cleaning fluid. The gel may be formed from a liquid friction-reducing fluid comprising either an emulsion comprising a continuous hydrocarbon phase and a discontinuous phase comprising a polymeric fluid-friction reducer or a suspension of polymer powder in a liquid hydrocarbon. The polymeric fluid-friction reducer may be selected from the group consisting of polyacrylamide, poly 2-acrylamido-2-methylpropane sulfonic acid, polybutylene succinate, polybutylene succinate-co-adipate, polyhydroxybutyrate-valerate, polyhydroxybutyrate-covalerate, polycaprolactone, polyethylene terephthalate-based polymers, sulfonated polyethylene terephthalate, polyethylene oxide, polyethylene, polypropylene, polyvinyl alcohol, aliphatic aromatic copolyester, polyacrylic acid, polyvinylpyrrolidone, polysaccharide, aliphatic polyester, polylactic acid, poly(glycolide), poly(ε-caprolactone), poly(hydroxy ester ether), poly(hydroxybutyrate), poly(anhydride), polycarbonate, poly(orthoester), poly (amino acid), poly(ethylene oxide), poly(propylene oxide), poly(phosphazene), derivatives thereof, and any combination thereof. The method may further comprise recycling the cleaning fluid. The method may further comprise injecting the cleaning fluid downhole.

Provided are systems for removing at least a portion of a gel from wellbore equipment in accordance with the disclosure. An example system comprises a storage container, wherein a cleaning fluid is disposed therein or thereon the storage container, and wherein the cleaning fluid comprising a brine having a total dissolved solids concentration of between about 30K ppm to about 300K ppm. The system further comprises a pump, a mixing tank, and a transporting conduit, and wherein the gel is disposed therein or thereon at least one of the pump, the mixing tank, or the transporting conduit.

Additionally or alternatively, the system may include one or more of the following features individually or in combination. The system may further comprise a second pump configured to introduce the cleaning fluid into at least one of the pump, the mixing tank, or the transporting conduit. The storage container may be a tote. The pump may be a chemical additive pump. The brine may comprise a dissolved salt selected from the group consisting of alkali metal salts, alkali earth metal salts, halide salts, chaotropic salts, kosmotropic salts, the like, derivatives thereof, hydrates thereof, and any combination thereof. The brine may comprise an ion selected from the group consisting of lithium, sodium, potassium, rubidium, caesium, beryllium, magnesium, calcium, strontium, barium, radium, fluoride, chloride, bromide, iodide, aluminum, boron, gallium, indium, perchlorate, citrate, nitrate, phosphate, hydrogen phosphate, dihydrogen phosphate, sulfate, ammonium, tetramethylammonium, and any combination thereof. The brine may comprise an aqueous base fluid selected from the group consisting of freshwater, brackish water, saline water, seawater, saturated saltwater, disposal water, recycled water, produced water, formation water, Ellenberger brines, the like, and any combinations thereof. The gel may be formed from a liquid friction-reducing fluid comprising either an emulsion comprising a continuous hydrocarbon phase and a discontinuous phase comprising a polymeric fluid-friction reducer or a suspension of polymer powder in a liquid hydrocarbon. The polymeric fluid-friction reducer may be selected from the group consisting of polyacrylamide, poly 2-acrylamido-2-methylpropane sulfonic acid, polybutylene succinate, polybutylene succinate-co-adipate, polyhydroxybutyrate-valerate, polyhydroxybutyrate-covalerate, polycaprolactone, polyethylene terephthalate-based polymers, sulfonated polyethylene terephthalate, polyethylene oxide, polyethylene, polypropylene, polyvinyl alcohol, aliphatic aromatic copolyester, polyacrylic acid, polyvinylpyrrolidone, polysaccharide, aliphatic polyester, polylactic acid, poly(glycolide), poly(ε-caprolactone), poly(hydroxy ester ether), poly(hydroxybutyrate), poly(anhydride), polycarbonate, poly(orthoester), poly(amino acid), poly(ethylene oxide), poly(propylene oxide), poly(phosphazene), derivatives thereof, and any combination thereof.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of" or "consist of the various components and steps." Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A method for removing a gel from wellbore equipment, the method consisting of:

introducing a cleaning fluid into the wellbore equipment having the gel disposed therein or thereon, wherein the cleaning fluid consists of an aqueous base fluid and at least one species of dissolved salt, wherein the total dissolved solids concentration of the at least one species of dissolved salt is between about 30K ppm to about 300K ppm;

contacting the gel with the cleaning fluid in the wellbore equipment; and removing at least a portion of the gel and at least a portion of the cleaning fluid from the wellbore equipment.

2. The method of claim 1, wherein the wellbore equipment is operating and wherein the steps of claim 1 are performed without shutting down the wellbore equipment.

3. The method of claim 1, wherein the dissolved salt is selected from the group consisting of alkali metal salts, alkali earth metal salts, halide salts, chaotropic salts, kosmotropic salts, hydrates thereof, and any combination thereof.

4. The method of claim 1, wherein the dissolved salt comprises an ion selected from the group consisting of lithium, sodium, potassium, rubidium, caesium, beryllium, magnesium, calcium, strontium, barium, radium, fluoride, chloride, bromide, iodide, aluminum, boron, gallium, indium, perchlorate, citrate, nitrate, phosphate, hydrogen phosphate, dihydrogen phosphate, sulfate, ammonium, tetramethylammonium, and any combination thereof.

5. The method of claim 1, wherein the wellbore equipment comprises an apparatus selected from the group consisting of: a transporting conduit, mixing tank, storage container, pump, and any combination thereof.

6. The method of claim 1, wherein the aqueous base fluid is selected from the group consisting of freshwater, brackish water, saline water, seawater, saturated saltwater, disposal water, recycled water, produced water, formation water, Ellenberger brines, and any combinations thereof.

7. The method of claim 1, wherein the cleaning fluid was sourced from a produced or disposal water.

8. The method of claim 1, wherein the cleaning fluid was sourced from a produced or disposal water with the salt added to it.

9. The method of claim 1, wherein the gel is formed from a liquid friction-reducing fluid comprising either an emulsion comprising a continuous hydrocarbon phase and a discontinuous phase comprising a polymeric fluid-friction reducer or a suspension of polymer powder in a liquid hydrocarbon.

10. The method of claim 9, wherein the polymeric fluid-friction reducer is selected from the group consisting of polyacrylamide, poly 2-acrylamido-2-methylpropane sulfonic acid, polybutylene succinate, polybutylene succinate-co-adipate, polyhydroxybutyrate-valerate, polyhydroxybutyrate-covalerate, polycaprolactone, polyethylene terephthalate-based polymers, sulfonated polyethylene terephthalate, polyethylene oxide, polyethylene, polypropylene, polyvinyl alcohol, aliphatic aromatic copolyester, polyacrylic acid, polyvinylpyrrolidone, polysaccharide, aliphatic polyester, polylactic acid, poly(glycolide), poly(ε-caprolactone), poly(hydroxy ester ether), poly(hydroxybutyrate), poly(anhydride), polycarbonate, poly(orthoester), poly (amino acid), poly(ethylene oxide), poly(propylene oxide), poly(phosphazene), and any combination thereof.

11. The method of claim 1, wherein the wellbore equipment is located downhole.

* * * * *